US008162598B2

(12) United States Patent
Liang

(10) Patent No.: US 8,162,598 B2
(45) Date of Patent: Apr. 24, 2012

(54) GAS TURBINE SEALING APPARATUS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 655 days.

(21) Appl. No.: 12/355,878

(22) Filed: Jan. 19, 2009

(65) Prior Publication Data

US 2010/0074730 A1 Mar. 25, 2010

Related U.S. Application Data

(60) Provisional application No. 61/100,107, filed on Sep. 25, 2008.

(51) Int. Cl.
*F01D 11/02* (2006.01)

(52) U.S. Cl. ..... 415/174.1; 415/115; 415/174.5

(58) Field of Classification Search ..... 415/173.4, 415/173.5, 115, 116, 174.5, 191
See application file for complete search history.

(56) References Cited

U.S. PATENT DOCUMENTS 3,647,311 A 3/1972 Wootton et al.
5,340,274 A * 8/1994 Cunha ..... 415/115
5,352,087 A * 10/1994 Antonellis ..... 415/115
5,358,374 A * 10/1994 Correia et al. ..... 415/47
5,749,701 A * 5/1998 Clarke et al. ..... 415/115
5,813,827 A 9/1998 Nordlund et al.
5,833,244 A * 11/1998 Salt et al. ..... 277/421
5,988,975 A * 11/1999 Pizzi ..... 415/139
6,152,685 A 11/2000 Hagi
6,152,690 A 11/2000 Tomita et al.
6,217,279 B1 * 4/2001 Ai et al. ..... 415/110
6,558,114 B1 5/2003 Tapley et al.
7,201,564 B2 4/2007 Bolms et al.
7,234,918 B2 6/2007 Brillert et al.
7,527,469 B2 * 5/2009 Zborovsky et al. ..... 415/9
8,016,553 B1 * 9/2011 Liang ..... 415/174.5
2003/0180141 A1 * 9/2003 Kress et al. ..... 415/115

OTHER PUBLICATIONS

U.S. Appl. No. 12/022,302, filed Jan. 30, 2008, entitled Turbine Disc Sealing Assembly.

* cited by examiner

*Primary Examiner* — Steven Loke
*Assistant Examiner* — David Goodwin

(57) ABSTRACT

A gas turbine comprises forward and aft rows of rotatable blades coupled to a disc/rotor assembly, a row of stationary vanes positioned between the forward and aft rows of rotatable blades, and rotatable sealing apparatus. Each of the stationary vanes comprises an inner diameter platform having first sealing structure. The rotatable sealing apparatus comprises seal housing apparatus coupled to the disc/rotor assembly and has second sealing structure adapted to engage with the first sealing structure.

19 Claims, 7 Drawing Sheets

GAS TURBINE SEALING APPARATUS

CROSS-REFERENCE TO RELATED APPLICATION

This application claims the benefit of U.S. Provisional Application Ser. No. 61/100,107, entitled TURBINE RIM CAVITY SEALING CONSTRUCTION TECHNIQUE, filed Sep. 25, 2008, by George Liang, the entire disclosure of which is incorporated by reference herein.

FIELD OF THE INVENTION

The present invention relates generally to a sealing apparatus for use in a gas turbine engine.

BACKGROUND OF THE INVENTION

In multistage rotary machines used for energy conversion, for example, a fluid is used to produce rotational motion. In a gas turbine engine, for example, a gas is compressed in a compressor and mixed with a fuel in a combustor. The combination of gas and fuel is then ignited for generating hot combustion gases that are directed to turbine stage(s) to produce rotational motion. Both the turbine stage(s) and the compressor have stationary or non-rotary components, such as vanes, for example, that cooperate with rotatable components, such as rotor blades, for example, for compressing and expanding the working gases. Many components within the machines must be cooled by cooling fluid to prevent the components from overheating.

Leakage between hot gas in a hot gas flow path and cooling fluid (air) within cavities in the machines, i.e., rim or vane cavities, reduces engine performance and efficiency. Cooling air leakage from the cavities into the hot gas flow path can disrupt the flow of the hot gases and increase heat losses. Further, the more cooling air that is leaked into the hot gas flow path, the higher the primary zone temperature in the combustor must be to achieve the required engine firing temperature. Additionally, hot gas leakage into the rim/vane cavities yields higher vane and vane platform temperatures and may result in reduced performance.

SUMMARY OF THE INVENTION

In accordance with one aspect of the present invention, a vane is provided adapted to be used in a gas turbine engine. The vane comprises an airfoil, an outer diameter portion, and an inner diameter portion. The outer diameter portion is coupled to the airfoil and includes connecting structure adapted to mate with connecting structure of a turbine casing so as to connect the vane to the turbine casing. The inner diameter platform is coupled to the airfoil and comprises first sealing structure adapted to engage with rotatable sealing apparatus. The sealing structure defines at least in part a radially innermost surface of the vane.

The radially innermost surface may have a curvature in a circumferential direction and angled in an axial direction relative to horizontal.

A bore may extend through the outer diameter portion and the airfoil and at least one cooling air passage may be provided in the platform in communication with the bore, wherein cooling air is adapted to pass into the bore and out through the passage.

The first sealing structure may extend axially and circumferentially along the platform.

The inner diameter platform may comprise a substantially constant thickness in a radial direction throughout its entirety.

The first sealing structure may comprise an abrasive layer, labyrinth teeth or honeycomb seal material.

In accordance with another aspect of the present invention, sealing apparatus is provided in a gas turbine comprising forward and aft rows of rotatable blades coupled to a disc/rotor assembly and a row of stationary vanes positioned between the forward and aft rows of rotatable blades. The sealing apparatus comprises seal housing apparatus coupled to the disc/rotor assembly, first seal retainer plate structure, second seal retainer plate structure, a first seal member and a second seal member. The first seal retainer plate structure is associated with the forward row of rotatable blades and has first axially extending seal structure. The second seal retainer plate structure is associated with the aft row of rotatable blades and has second axially extending seal structure. The first seal member is associated with the first axially extending seal structure and the seal housing apparatus so as to seal a gap between the first seal retainer plate structure and the seal housing apparatus. The second seal member is associated with the second axially extending seal structure and the seal housing apparatus so as to seal a gap between the second seal retainer plate structure and the seal housing apparatus.

The seal housing apparatus may comprise radially inner and outer seal housing structures, the first and second seal members being positioned between the inner and outer seal housing structures.

The radially outer seal housing structure has a radially outer surface that may comprise sealing structure adapted to engage with sealing structure provided on radially inner surfaces of each of the vanes.

The first seal member may comprise a single row of fingers in a radial direction, wherein gaps are provided between adjacent fingers.

The first seal member may comprise first and second rows of fingers, where first gaps may be provided between adjacent first fingers and second gaps may be provided between adjacent second fingers, the first row of fingers being radially spaced from the second row of fingers and the first gaps being spaced apart from the second gaps in a circumferential direction.

In accordance with a yet another aspect of the present invention a gas turbine is provided. The gas turbine comprises forward and aft rows of rotatable blades coupled to a disc/rotor assembly, a row of stationary vanes positioned between the forward and aft rows of rotatable blades, and rotatable sealing apparatus. Each of the stationary vanes comprises an inner diameter platform having first sealing structure. The rotatable sealing apparatus comprises seal housing apparatus coupled to the disc/rotor assembly and has second sealing structure adapted to engage with the first sealing structure.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
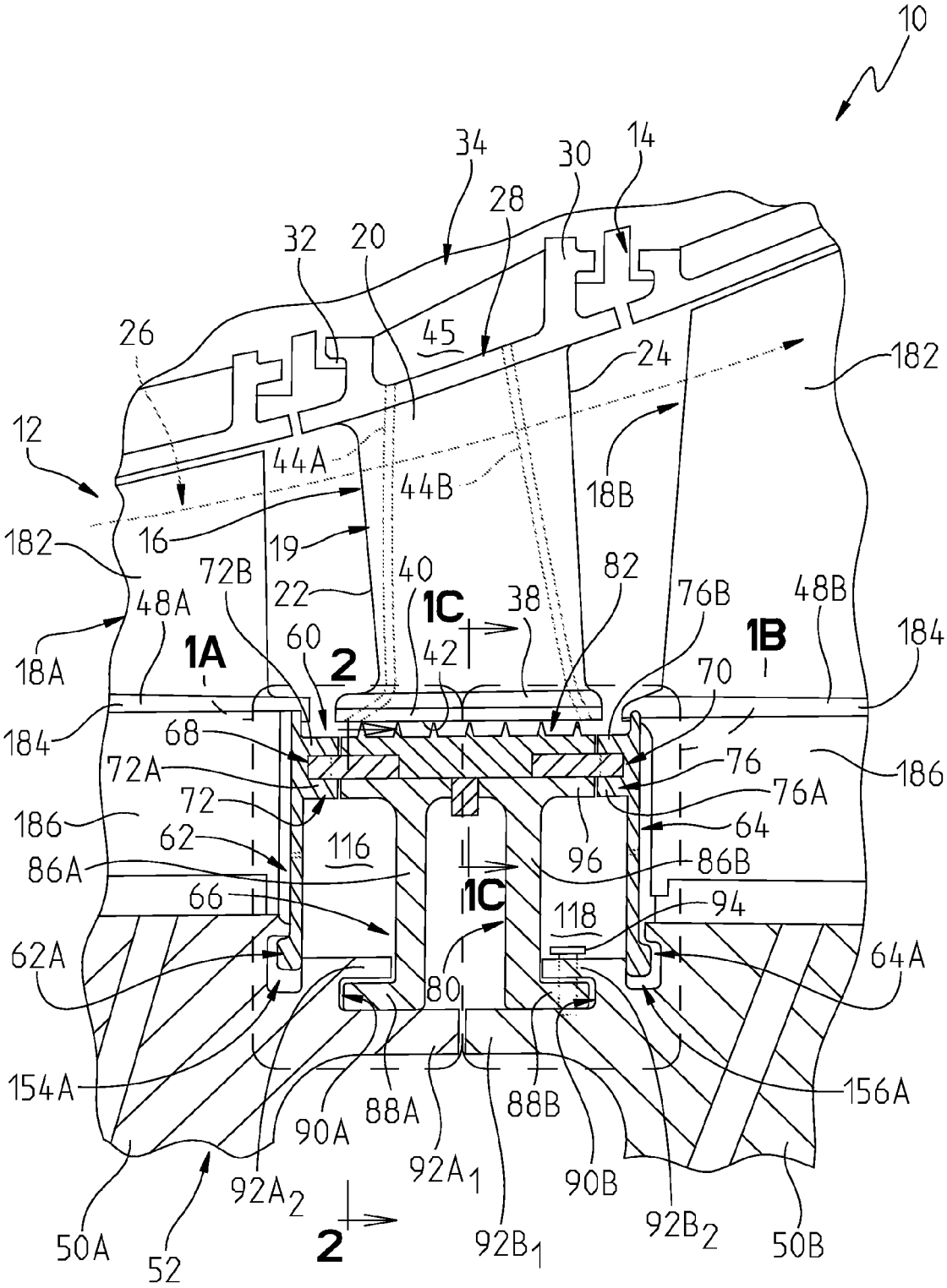
FIG. 1 is a diagrammatic sectional view of a portion of a gas turbine engine including a cavity seal assembly in accordance with the invention.

Referring to FIG. 1, a portion of a turbine section comprising adjoining stages 12, 14 of a gas turbine engine 10 is illustrated. Each stage 12, 14 comprises stationary components, illustrated herein as a row of vanes 16, and a row of rotatable blades, illustrated herein as a forward row of blades 18A, which correspond to the first stage 12, and an aft row of blades 18B, which correspond to the second stage 14.

Each row of vanes is defined by a plurality of circumferentially spaced-apart vanes 19. Each vane 19 comprises an airfoil 20, an outer diameter portion 28 coupled to the airfoil 20 and an inner diameter platform 38 coupled to the airfoil 20. Each airfoil 20 comprising a leading edge 22 and an axially spaced trailing edge 24. Gaps between the adjacent, circumferentially spaced-apart airfoils 20 define a portion of a hot gas flow path 26. The hot gas flow path 26 extends axially through the turbine section of the engine 10 and defines a passage along which hot combustion gases travel as they move through the turbine section of the engine 10.

The outer diameter portion 28 of each vane 19 comprises connecting structure 30. The connecting structure 30 mates with corresponding connecting structure 32 of a turbine casing 34 so as to connect the corresponding vane 19 to the turbine casing 34.

The inner diameter platform 38 in the embodiment shown in FIG. 1 has a substantially constant thickness in a radial direction throughout its entirety, i.e., in axial and circumferential directions. The inner diameter platform 38 comprises a first sealing structure 40 comprising an abrasive layer in the embodiment shown, but may comprise other structure, such as, for example, labyrinth teeth or honeycomb seal material. The abrasive layer may be formed, for example from a combination of yttria and zirconia, while the remaining portion of the inner diameter platform 38 may be formed, for example from a metal alloy. A conventional bonding material may be used to bond the abrasive layer to the remaining portion of the inner diameter platform 38. The first sealing structure 40 extends axially and circumferentially as part of the inner diameter platform 38 and defines a radially innermost surface 42 of the vane 19. In the embodiment shown in FIG. 1, the radially innermost surface 42 of the vane 19 has a curvature in a circumferential direction and is substantially linear in the axial direction so as to be substantially parallel to a central axis of the turbine section or horizontal.

As shown in FIG. 1, first and second bores 44A and 44B extend through the outer diameter portion 28 and the airfoil 20. The bores 44A, 44B are in communication with and receive cooling air from a cooling air pocket 45 located between the outer diameter portion 28 of the vane 19 and the connecting structure 32 of the of turbine casing 34. The bores 44A, 44B communicate with and deliver the cooling air from the cooling air pocket 45 into respective first and second cooling fluid passages 46A, 46B, see FIGS. 1A and 1B, formed in the inner diameter platform 38 including the abrasive layer defining the first sealing structure 40. The cooling air flows out of the first and second cooling fluid passages 46A, 46B to provide cooling as will be described below.

The forward and aft rows of blades 18A, 18B each comprise a plurality of circumferentially spaced-apart turbine blades. Each blade 18A, 18B may comprise an airfoil 182, a platform 184 and a root 186, wherein the airfoil 182, platform 184 and root 186 may be integrally formed together. The forward and aft rows of blades 18A, 18B are coupled to respective first and second rotor discs 50A, 50B of a disc/rotor assembly 52 via their roots 186. Gaps between adjacent circumferentially spaced-apart blades 18A, 18B define respective portions of the hot gas flow path 26.

Figure 1A:
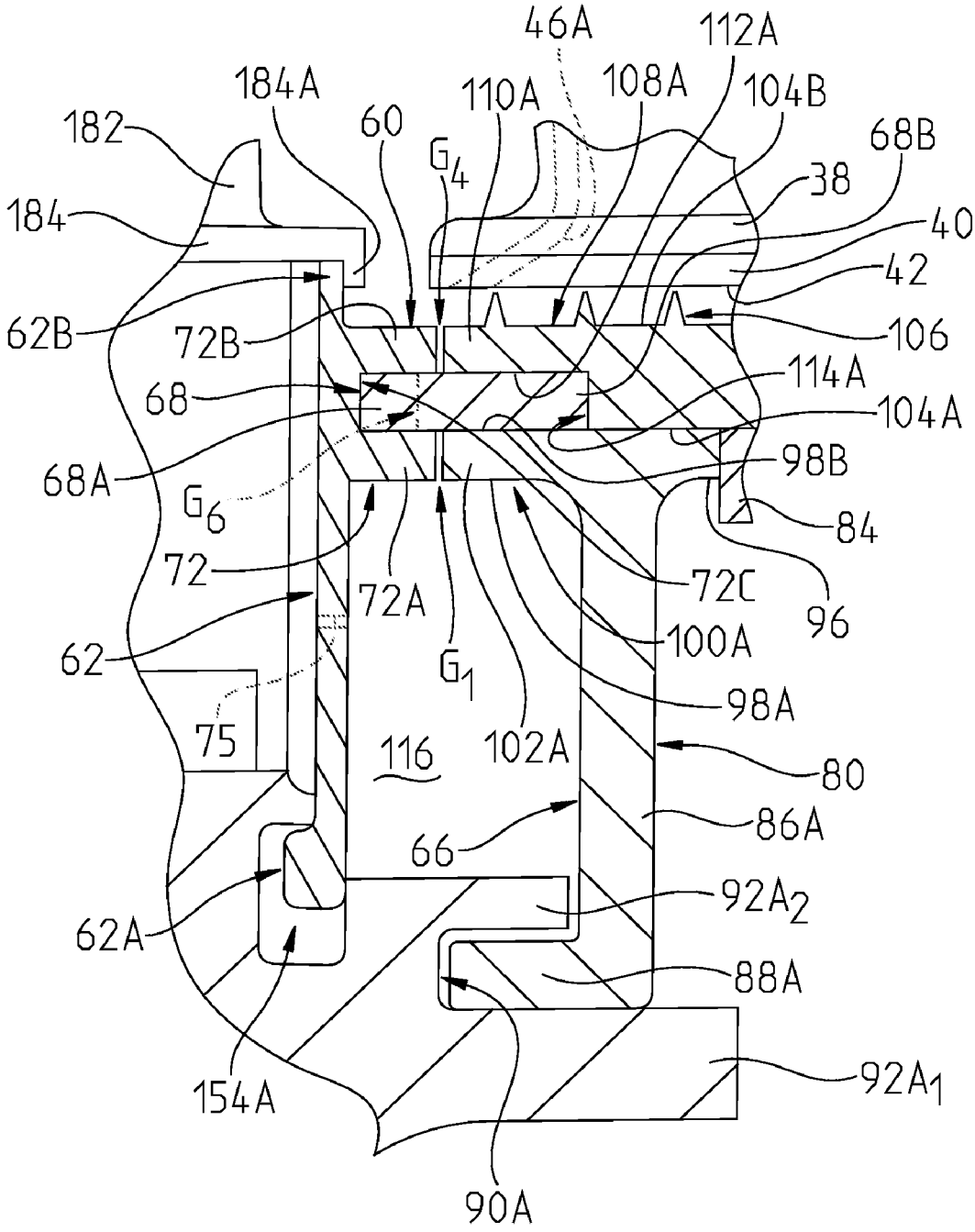
FIG. 1A is an enlarged sectional view of an area, as identified in FIG. 1, illustrating a portion of the cavity seal assembly.
Figure 1B:
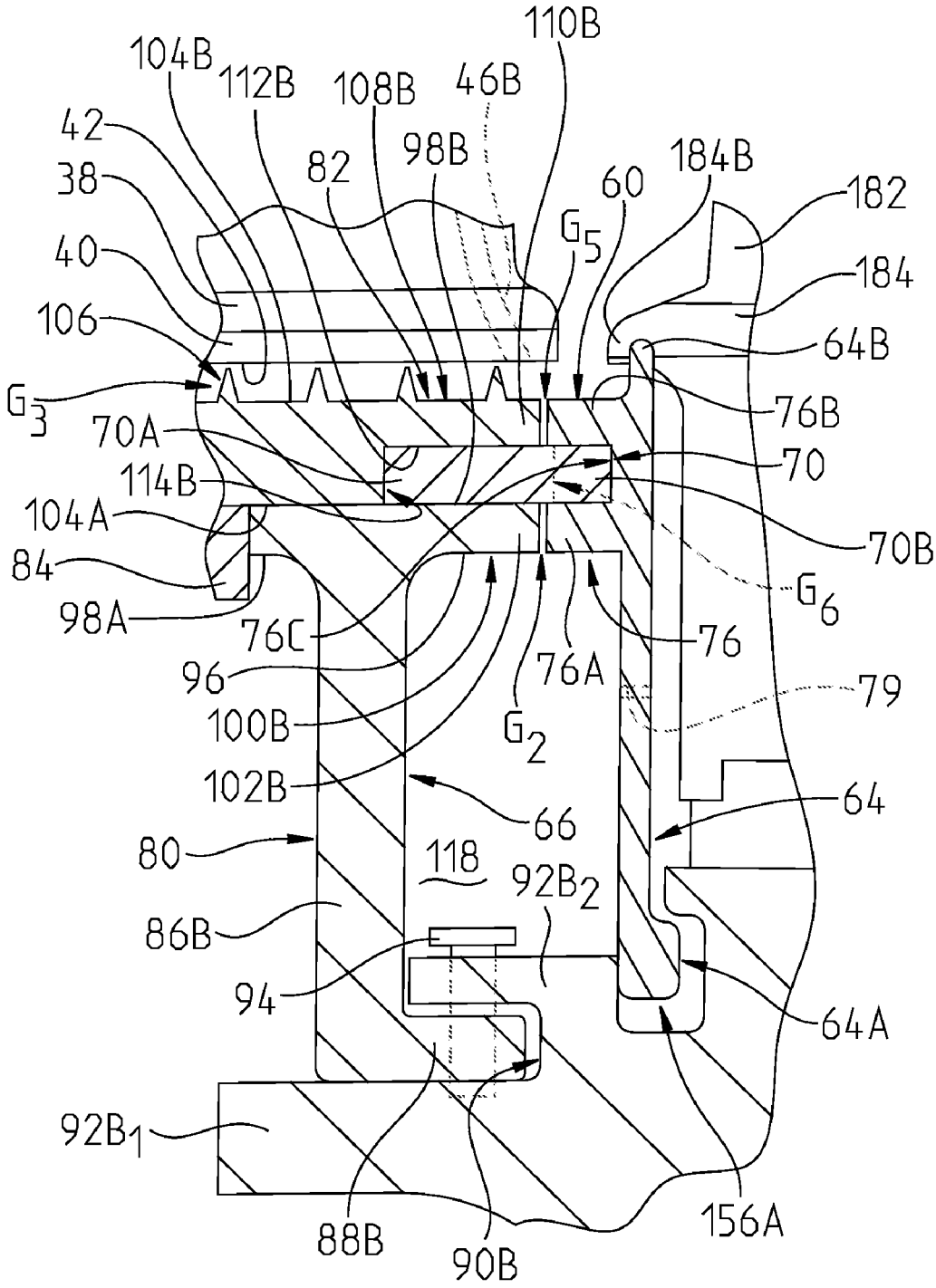
FIG. 1B is an enlarged sectional view of an area, as identified in FIG. 1, illustrating a portion of the cavity seal assembly.

Referring to FIGS. 1, 1A, and 1B, a sealing apparatus 60 according to an embodiment of the invention is shown. The sealing apparatus 60 is positioned between and rotates with the forward row of blades 18A and the aft rows of blades 18B. The sealing apparatus 60 comprises a first seal retainer plate structure 62, a second seal retainer plate structure 64, a seal housing apparatus 66, a first seal member 68, and a second seal member 70. It is noted that the sealing apparatus 60 extends circumferentially about the disc/rotor assembly 52. The sealing apparatus 60 may be formed in discrete circumferential sections, see FIG. 2, where first, second, third and fourth sections $S_1$, $S_2$, $S_3$, $S_4$ are illustrated. The discrete circumferential sections, when assembled about the disc/rotor assembly 52, define a corresponding sealing apparatus 60 that extends completely about the entire disc/rotor assembly 52. In a preferred embodiment, the sealing apparatus 60 may be formed in discrete sections comprising 22.5°, 45°, 90°, or 180° sections of the full sealing apparatus 60 (which is typically a 360° sealing apparatus 60), although other configurations may be used. Each discrete section of the sealing apparatus 60 comprises a corresponding first seal retainer plate structure section, second seal retainer plate structure section, seal housing apparatus section, first seal member section, and second seal member section.

Referring to FIGS. 1 and 1A, the first seal retainer plate structure 62 is associated with the forward row of blades 18A. The first seal retainer plate structure 62, which, as noted above, may comprise a plurality of discrete circumferentially extending sections, comprises a first L-shaped end 62A and a second end 62B, see FIG. 1A. The first L-shaped end 62A is received in a first recess 154A defined in the first rotor disc 50A of the disc/rotor assembly 52. The second end 62B is engaged and held in position by L-shaped end portions 184A of the platforms 184 of the blades 18A, see FIG. 1A. The first seal retainer plate structure 62 rotates with the blades 18A and the first rotor disc 50A.

The first seal retainer plate structure 62 in the embodiment shown further comprises first axially extending seal structure 72 comprising first and second axially extending legs 72A and 72B, which define a first recess 72C therebetween, see FIG. 1A. One or a plurality of cooling fluid apertures 75, see FIG. 1A, may be formed in the first seal retainer plate structure 62 for permitting a cooling fluid to flow therethrough as will be described below.

Referring to FIGS. 1 and 1B, the second seal retainer plate structure 64 is associated with the aft row of blades 18B. The second plate structure 64, which, as noted above, may comprise a plurality of discrete circumferentially extending sections, comprises a third L-shaped end 64A and a fourth end 64B, see FIG. 1B. The third L-shaped end 64A is received in a second recess 156A defined in the second rotor disc 50B of the disc/rotor assembly 52. The fourth end 64B is engaged and held in position by end portions 184B of the platforms 184 of the aft blades 18B, see FIG. 1B. The second seal retainer plate structure 64 rotates with the blades 18B and the second rotor disc 50B.

The second seal retainer plate structure 64 in the embodiment shown further comprises second axially extending seal structure 76 comprising first and second axially extending legs 76A and 76B, which define a second recess 76C therebetween, see FIG. 1B. One or a plurality of cooling fluid apertures 79, see FIG. 1B, may be formed in the second seal retainer plate structure 64 for permitting a cooling fluid to flow therethrough as will be described below.

The seal housing apparatus 66 comprises a radially inner seal housing structure 80 and a radially outer seal housing structure 82 coupled together, although it is understood that the radially inner and outer seal housing structures 80, 82 may comprise a single seal housing structure. The radially outer seal housing structure 82 comprises one or more circumferentially spaced apart L-shaped connection structures 84 for coupling the outer seal housing structure 82 to the inner seal housing structure 80, see FIG. 1C, such that, during operation of the engine 10, the radially inner and outer seal housing structures 80, 82 are rotatable together in a direction of operation of the disc/rotor assembly 52 (into the page as shown in FIGS. 1, 1A, and 1B) but are able to be rotated with respect to each other in a direct opposite to that of the direction of operation of the disc/rotor assembly 52 (out of the page as shown in FIGS. 1, 1A, and 1B).

Figure 1C:
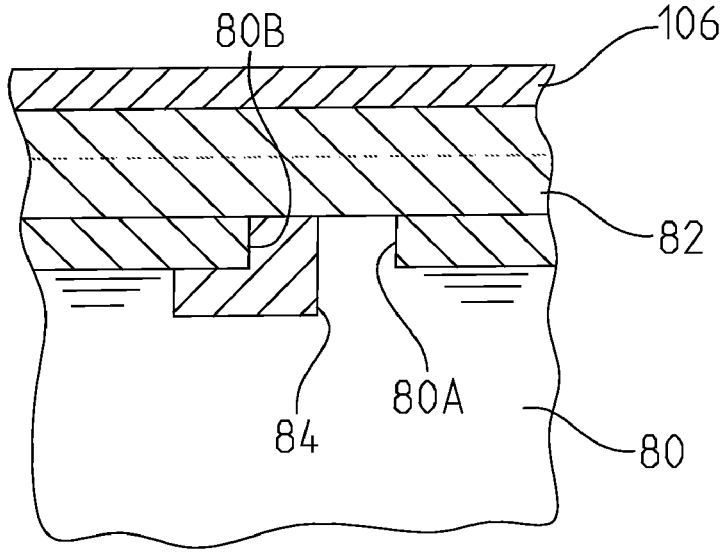
FIG. 1C is an enlarged cross sectional view of a portion of the cavity seal assembly taken along line 1C-1C in FIG. 1.

Each connection structure 84 in the embodiment shown is affixed to or integrally formed with the outer seal housing structure 82 and is inserted into a corresponding circumferentially enlarged aperture 80A, see FIG. 1C, formed in the inner seal housing structure 82. The inner and outer seal housing structures 80, 82 are then rotated circumferentially in opposite directions with respect to each other until the connection structure 84 abuts a radially extending surface 80B of the inner seal housing structure 80, as shown in FIG. 1C. The connection structure 84 allows the radially inner and outer seal housing structures 80, 82 to be assembled and disassembled more efficiently, i.e. in the case that the radially outer seal housing structure 82 must be repaired or replaced.

Figure 2:
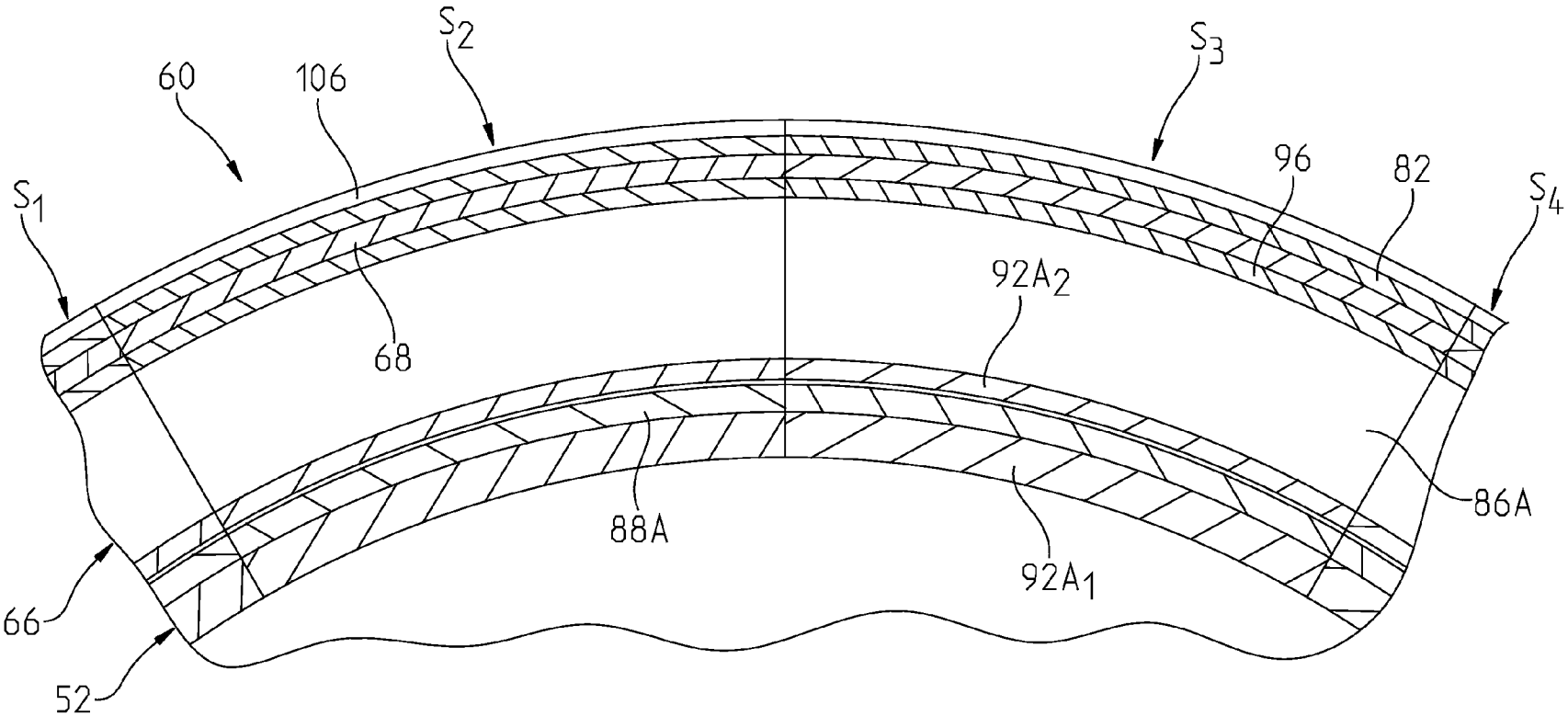
FIG. 2 is a cross sectional view of a portion of the cavity seal assembly taken along line 2-2 in FIG. 1.

The radially inner seal housing structure 80, which may comprise a plurality of discrete circumferential sections, extends circumferentially about the disc/rotor assembly 52 as most clearly shown in FIG. 2. The radially inner seal housing structure 80 comprises first and second axially spaced apart and generally radially extending leg portions 86A, 86B (see FIGS. 1, 1A, and 1B), which leg portions 86A, 86B each include a respective generally axially extending L-shaped foot portion 88A, 88B. Each foot portion 88A, 88B may be integrally formed with a corresponding remaining section of its respective leg portion 86A, 86B.

The foot portions 88A, 88B are received in slots 90A, 90B formed in respective ones of the rotor discs 50A, 50B of the disc/rotor assembly 52. The slots 90A, 90B are defined by pairs of axially extending members 92$A_1$, 92$A_2$ and 92$B_1$, 92$B_2$ of the respective rotor discs 50A, 50B. Optionally, one or more retaining structures, illustrated in FIGS. 1 and 1B as an anti-rotation pin 94, are associated with one or both of the foot portions 88A, 88B (one anti-rotation pin 94 associated with the second foot portion 88B is shown in FIGS. 1 and 1B) and the axially extending members 92$A_1$, 92$A_2$ and 92$B_1$, 92$B_2$ of the respective rotor disc 50A, 50B. The anti-rotation pin 94 substantially prevents relative rotation between the disc/rotor assembly 52 and the seal housing apparatus 66.

The radially inner seal housing structure 80 also includes a plate-like member 96 that comprises a radially inner surface 98A and an opposed radially outer surface 98B, see FIGS. 1A and 1B. The radially inner surface 98A may be integrally formed with the first and second leg portions 86A, 86B. The radially outer surface 98B has a curvature in a circumferential direction and defines a substantially flat surface in the axial direction which engages the radially outer seal housing structure 82 of the seal housing apparatus 66.

As shown in FIG. 1A, an axial forward end portion 100A of the plate-like member 96 defines a forward inner seal member 102A. The forward inner seal member 102A extends in the axial direction to a location proximate the first axially extending leg 72A of the first seal structure 72. A first gap $G_1$ is formed between the forward inner seal member 102A and the first axially extending leg 72A. As shown in FIG. 1B, an axial aft end portion 100B of the plate-like member 96 defines an aft inner seal member 102B. The aft inner seal member 102B extends in the axial direction to a location proximate the first axially extending leg 76A of the second seal structure 76. A second gap $G_2$ is formed between the aft inner seal member 102B and the first axially extending leg 76A.

The radially outer seal housing structure 82 of the seal housing apparatus 66 comprises a radially inner surface 104A and an opposed radially outer surface 1048, as shown in FIGS. 1A and 1B. The radially inner surface 104A abuts the radially outer surface 98B of the radially inner seal housing structure 80 of the seal housing apparatus 66. The radially outer surface 104B has a curvature in a circumferential direction and includes associated second sealing structure comprising a plurality of seal teeth 106 in the illustrated embodiment.

The seal teeth 106 extend radially outwardly from the radially outer surface 104B of the outer seal housing structure 82 and come into close proximity or engage with the first sealing structure 40 defining the radially innermost surface 42 of each vane 19, as shown in FIGS. 1, 1A and 1B. The seal teeth 106 and the first sealing structure 40 provide a reduced radial clearance between the rotatable seal housing apparatus 66 and each stationary vane 19 for limiting gas flow through a third gap $G_3$ formed between the seal housing apparatus 66 and each vane 19, see FIG. 1B.

As shown in FIG. 1A, the radially outer seal housing structure 82 comprises an axial forward end portion 108A that defines a forward outer seal member 110A. The forward outer seal member 110A extends in the axial direction to a location proximate the second axially extending leg 72B of the first axially extending seal structure 72 of the first seal retainer plate structure 62. A fourth gap $G_4$ is formed between the forward outer seal member 110A and the second axially extending leg 72B of the first axially extending seal structure 72.

The forward inner seal member 102A of the radially inner seal housing structure 80 and the forward outer seal member 110A of the radially outer seal housing structure 82 define a third recess 114A therebetween, see FIG. 1A.

As shown in FIG. 1B, the radially outer seal housing structure 82 further comprises an axial aft end portion 108B that defines an aft outer seal member 110B. The aft outer seal member 110B extends in the axial direction to a location proximate the second axially extending leg 76B of the second axially extending seal structure 76 of the second seal retainer plate structure 64. A fifth gap $G_5$ is formed between the aft outer seal member 110B and the second axially extending leg 76B of the second axially extending seal structure 76.

The aft inner seal member 102B of the radially inner seal housing structure 80 and the aft outer seal member 110B of the radially outer seal housing structure 82 define a fourth recess 114B therebetween, see FIG. 1B.

As shown in FIG. 1A, an axially forward end portion 68A of the first seal member 68 is received in the first recess 72C between the first and second axially extending legs 72A, 72B of the first axially extending seal structure 72 of the first seal retainer plate structure 62. An axially aft end portion 68B of the first seal member 68 is received in the third recess 114A defined by the forward inner seal member 102A of the radially inner seal housing structure 80 and the forward outer seal member 110A of the radially outer seal housing structure 82. The first seal member 68 is held in place between the first seal retainer plate structure 62 and the seal housing apparatus 66 and seals the gaps $G_1$ and $G_4$ formed between the first seal retainer plate structure 62 and the seal housing apparatus 66. The seal member 68 may comprise a plurality of discrete seal member sections positioned adjacent to one another in a circumferential direction.

As shown in FIG. 1B, an axially forward end portion 70A of the second seal member 70 is received in the fourth recess 114B defined by the aft inner seal member 102B of the radially inner seal housing structure 80 and the aft outer seal member 110B of the radially outer seal housing structure 82. An axially aft end portion 70B of the second seal member 70 is received in the second recess 76C defined between the first and second axially extending legs 76A, 76B of the second axially extending seal structure 76 of the second seal retainer plate structure 64. The second seal member 70 is held in place between the seal housing apparatus 66 and the second seal retainer plate structure 64 and seals the gaps $G_2$ and $G_5$ formed between the second seal retainer plate structure 64 and the seal housing apparatus 66. The seal member 70 may comprise a plurality of discrete seal member sections positioned adjacent to one another in a circumferential direction.

Figure 1D:
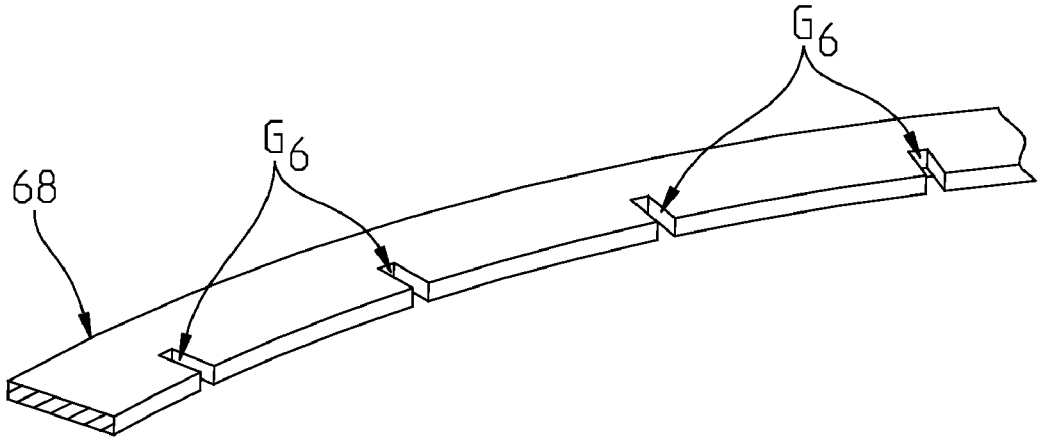
FIG. 1D is a partial perspective view of a seal member illustrated in FIG. 1.

It is noted that the first and second seal members 68, 70 may include an array of radially extending gaps $G_6$ (see the first seal member 68 illustrated in FIG. 1D) formed therein with circumferentially spaced fingers provided between the gaps $G_6$. The gaps $G_6$ and fingers provide for flexibility in the seal members 68, 70. The gaps $G_6$ may extend only a partial axial length of the first and second seal members 68, 70, as shown in FIG. 1D. In the embodiment illustrated in FIGS. 1, 1A, 1B, and 1D, the first and second seal members 68, 70 comprise a single row of fingers in the radial direction As stated above, the first seal member 68 seals the gaps $G_1$, $G_4$ formed between the first seal retainer plate structure 62 and the seal housing apparatus 66. Thus, the first seal member 68 substantially prevents hot combustion gases flowing in the hot gas flow path 26 from leaking into a first cavity 116 (see FIGS. 1 and 1A) formed between the first leg portion 86A of the seal housing apparatus 66 and the first seal retainer plate structure 62. The first seal member 68 also substantially prevents cooling air, which is typically located in the first cavity 116, i.e., that enters the first cavity 116 through the cooling fluid aperture 75 formed in the first seal retainer plate structure 62, from leaking into the hot gas flow path 26.

The cooling fluid is advantageously conveyed into the first cavity 116 for cooling purposes, i.e., to cool the components of the sealing apparatus 60. Further, the cooling fluid affects the pressure differential between the hot gas flow path 26 and the first cavity 116, i.e., raises the pressure within the first cavity 116 at least as high as the pressure within the hot gas flow path 26, such that leakage between the hot combustion gases from the hot gas flow path 26 and the cooling fluid in the first cavity 116, if any, is from the first cavity 116 into the hot gas flow path 26. The second seal member 70 similarly prevents leakage between the hot gas flow path 26 and a second cavity 118, see FIGS. 1 and 1B, which second cavity 118 is located between the second leg portion 86B of the seal housing apparatus 66 and the second seal retainer plate structure 64. It is noted that since the first and second cavities 116 and 118 are smaller in size than cavities included in prior art engines, a smaller amount of cooling fluid can be used in the first and second cavities 116 and 118 to achieve desired cooling and pressure advantages as compared to the amount of cooling fluid required to achieve desired cooling and pressure advantages in prior art engines with larger cavities.

Further, as discussed above, the seal teeth 106 and the sealing structure 40 of the inner diameter platform 38 create a reduced radial clearance between each vane 19 and the seal housing apparatus 66. Thus, the passage of hot combustion gases through each gap $G_3$ is reduced. However, an amount of cooling fluid flows from the cooling air pocket 45 through the bores 44A, 44B formed in the outer diameter portions 28 and the airfoils 20 and then exits the vanes 19 through the cooling air passages 46A, 46B formed in the inner diameter platform 38. This cooling fluid flows through the gap $G_3$ to provide cooling to the inner diameter platform 38 and the radially outer seal housing structure 82 of the seal housing apparatus 66. It is noted that cooling air flowing out of the cooling air passages 46A, 46B assists in preventing the hot combustion gases from flowing through the gap $G_3$, i.e., by pushing the hot combustion gases away from the gap $G_3$.

Figure 3:
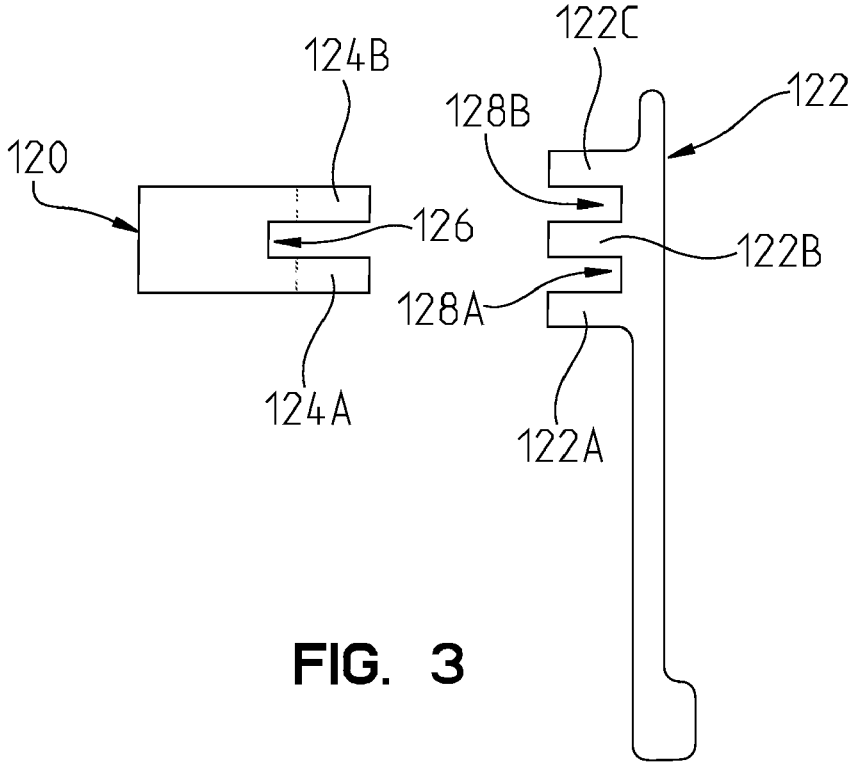
FIG. 3 is an exploded sectional view of a seal structure according to an embodiment of the invention.

Referring now to FIG. 3, a seal member 120 and an associated seal retainer plate 122 according to another embodiment of the invention are shown. The seal member 120 is also associated with a seal housing apparatus (not shown in this embodiment), and is adapted to replace the first and/or second seal member 68, 70 disclosed above for FIGS. 1, 1A, 1B, and 2.

Figure 3A:
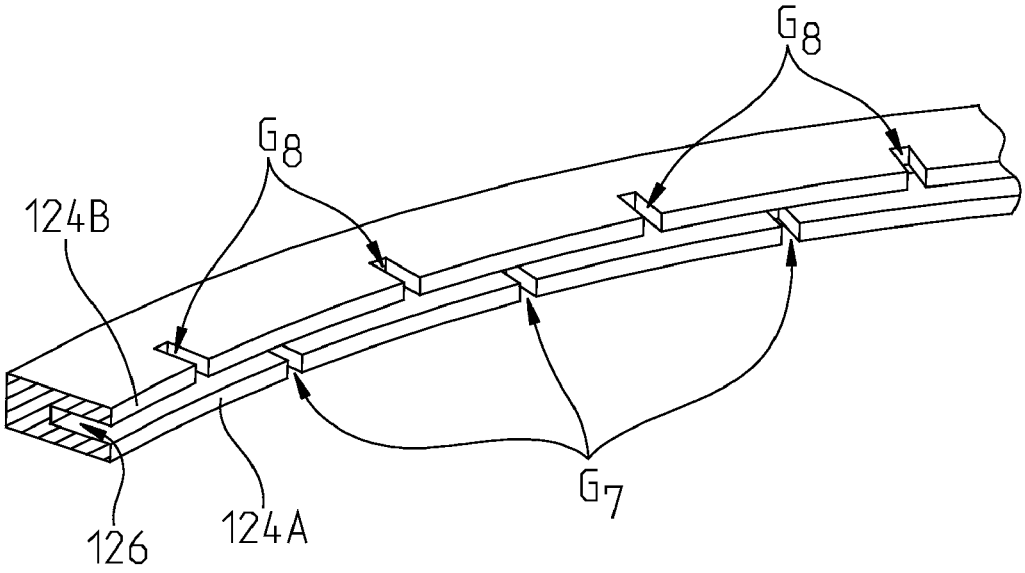
FIG. 3A is a partial perspective view of a component of the seal structure illustrated in FIG. 3.

In this embodiment, the seal member 120 comprises first and second rows of axially extending fingers 124A, 124B (see FIGS. 3 and 3A). The first and second rows of axially extending fingers 124A, 124B are radially spaced apart from each other such that a slot 126 is formed therebetween. As shown in FIG. 3A, first and second radially extending gaps $G_7$, $G_8$, respectively, may be formed in the seal member 120 to define the first and second rows of axially extending fingers 124A, 124B. The gaps $G_7$, $G_8$ may extend only a partial axial length of the seal member 120 as shown in FIG. 3A. The gaps $G_7$, $G_8$ illustrated in FIG. 3A are arranged in a staggered relationship, such that no gap $G_7$ located between adjacent axially extending fingers 124A is radially aligned with any gap $G_8$ located between adjacent axially extending fingers 124B. Thus, a seal provided by the seal member 120 is more efficient, i.e., fluid leakage around the seal member 120 is reduced as a direct radial path through the gaps $G_7$, $G_8$ is avoided. The gaps $G_7$, $G_8$ permit an amount of thermal expansion of the first and second rows of axially extending fingers 124A, 124B, i.e., as might be encountered during operation of a gas turbine engine in which the seal member 120 is disposed.

The seal retainer plate 122 in this embodiment includes a radially inner axially extending structure 122A, an intermediate axially extending structure 122B, and a radially outer axially extending structure 122C. When the seal retainer plate 122 and the seal member 120 are positioned within the engine, they are positioned such that the radially inner, intermediate, and radially outer axially extending structures 122A, 122B, 122C cooperate with the first and second rows of axially extending fingers 124A, 124B to provide a seal within the engine, i.e., between a hot gas flow path and a cavity (neither of which is shown in this embodiment). Specifically, the intermediate axially extending structure 122B is received within the slot 126 formed between the first and second rows of axially extending fingers 124A, 124B. Additionally, the first row of axially extending fingers 124A is received in a first slot 128A formed between the radially inner axially extending structure 122A and the intermediate axially extending structure 122B. Moreover, the second row of axially extending fingers 124B is received in a second slot 128B formed between the intermediate axially extending structure 1228 and the radially outer axially extending structure 122C.

Figure 4:
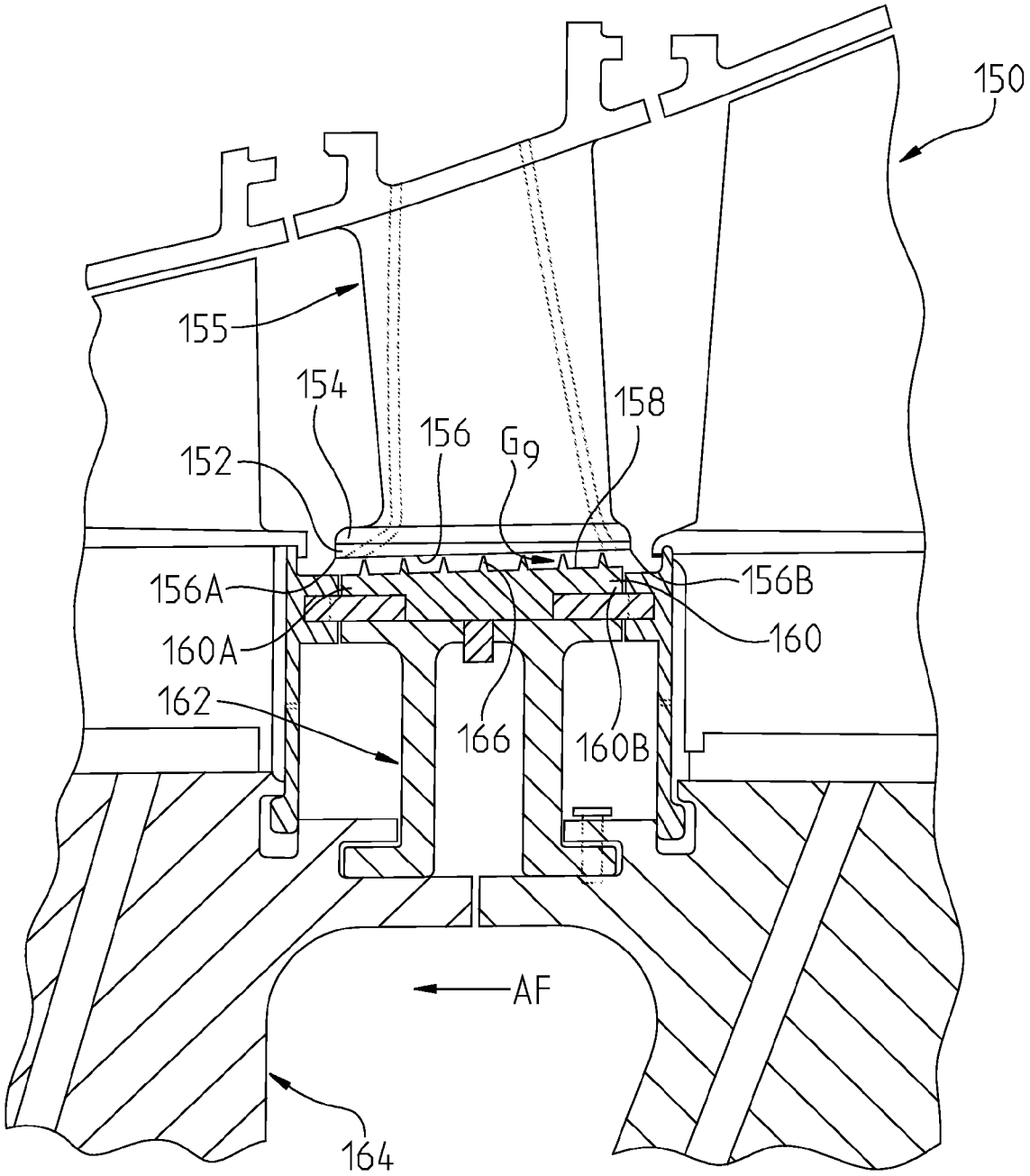
FIG. 4 is a diagrammatic sectional view of a portion of a gas turbine engine including a cavity seal assembly in accordance with another embodiment of the invention.

Referring now to FIG. 4, a portion of a turbine section of a gas turbine engine 150 according to another embodiment of the invention in shown. In this embodiment, a sealing structure 152 comprising part of an inner diameter platform 154 of a vane 155 is configured such that a radially inner surface 156 of the sealing structure 152 includes a curvature in a circumferential direction and is angled in an axial direction relative to horizontal. The sealing structure 152 according to this embodiment preferably comprises an abrasive layer formed for example from a combination of yttria and zirconia. As shown in FIG. 4, the radially inner surface 156 of the sealing structure 152 is sloped radially outwardly from a forward end 156A thereof to an aft end 156B thereof. Thus, a radial thickness of the sealing structure 152 at the forward end 156A thereof is greater than a radial thickness of the sealing structure 152 at the aft end 156B thereof.

A radially outer surface 158 of a radially outer seal housing structure 160 of a seal housing apparatus 162 is correspondingly shaped to the shape of the sealing structure 152, i.e., the radially outer surface 158 includes a curvature in the circumferential direction and is angled in the axial direction relative to horizontal. Hence, a radial dimension of a gap $G_9$ formed between the radially inner surface 156 of the sealing structure 152 and the radially outer surface 158 of the radially outer seal housing structure 160 remains substantially the same from a forward end portion 160A of the radially outer seal housing structure 160 to an aft end portion 160B of the radially outer seal housing structure 160.

During operation of the engine 150, it has been found that a disc/rotor assembly 164 to which the seal housing apparatus 162 is affixed tends to move slightly axially forward relative to the vanes 155 in the direction of arrow AF in FIG. 4. If this relative axial movement occurs, a radial slope of the gap $G_9$ facilitates a decrease in the radial distance between the radially inner surface 156 of the sealing structure 152 and the radially outer surface 158 of the radially outer seal housing structure 160, i.e., as the disc/rotor assembly 164 moves axially forward (to the left as shown in FIG. 4), the radially inner surface 156 of the sealing structure 152 becomes radially closer to the radially outer surface 158 of the radially outer seal housing structure 160. In this case, a radial clearance between radially inner surface 156 of the sealing structure 152 and seal teeth 166 of the radially outer seal housing structure 160 is reduced, thus providing an improved seal between the sealing structure 152 and the seal teeth 166. In some instances, the radially inner surface 156 of the sealing structure 152 may even come into contact with the seal teeth 166 of the radially outer seal housing structure 160. Since the sealing structure 152 according to this embodiment preferably comprises an abradable surface, any contact between the seal teeth 166 and the sealing structure 152 may result in a deterioration of the abradable material of the sealing structure 152, wherein the seal teeth 166 remain substantially unharmed.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Sealing apparatus in a gas turbine comprising forward and aft rows of rotatable blades coupled to a disc/rotor assembly and a row of stationary vanes positioned between said forward and aft rows of rotatable blades, said sealing apparatus comprising:

seal housing apparatus coupled to the disc/rotor assembly;

first seal retainer plate structure associated with the forward row of rotatable blades and having first axially extending seal structure;

second seal retainer plate structure associated with the aft row of rotatable blades and having second axially extending seal structure;

a first seal member engaged with said first axially extending seal structure and said seal housing apparatus so as to seal a gap between said first seal retainer plate structure and said seal housing apparatus; and a second seal member engaged with said second axially extending seal structure and said seal housing apparatus so as to seal a gap between said second seal retainer plate structure and said seal housing apparatus.

2. The sealing apparatus as set out in claim 1, wherein said seal housing apparatus comprises radially inner and outer seal housing structures, said first and second seal members being positioned between said inner and outer seal housing structures.

3. The sealing apparatus as set out in claim 2, wherein said radially outer seal housing structure has a radially outer surface comprising sealing structure adapted to engage with sealing structure provided on radially inner surfaces of each of the vanes.

4. The sealing apparatus as set out in claim 1, wherein said first seal member comprises a single row of fingers in a radial direction, wherein gaps are provided between adjacent fingers.

5. The sealing apparatus as set out in claim 1, wherein said first seal member comprises first and second rows of fingers, where first gaps are provided between adjacent first fingers and second gaps are provided between adjacent second fingers, said first row of fingers being radially spaced from said second row of fingers and said first gaps being spaced apart from said second gaps in a circumferential direction.

6. A gas turbine comprising:

forward and aft rows of rotatable blades coupled to a disc/rotor assembly;

a row of stationary vanes positioned between said forward and aft rows of rotatable blades, each of said vanes comprising an inner diameter platform having first sealing structure; and rotatable sealing apparatus comprising seal housing apparatus coupled to said disc/rotor assembly and having second sealing structure adapted to cooperate with said first sealing-structure;

first seal retainer plate structure associated with said forward row of rotatable blades and having first axially extending seal structure;

second seal retainer plate structure associated with said aft row of rotatable blades and having second axially extending seal structure;

a first seal member engaged with said first axially extending seal structure and said seal housing apparatus so as to seal a gap between said first seal retainer plate structure and said seal housing apparatus; and a second seal member engaged with said second axially extending seal structure and said seal housing apparatus so as to seal a Rap between said second seal retainer plate structure and said seal housing apparatus.

7. The gas turbine as set out in claim 6, wherein each of said vanes further comprises:

an airfoil coupled to said inner diameter platform;

an outer diameter portion coupled to said airfoil and including connecting structure adapted to mate with connecting structure of a turbine casing so as to connect said vane to the turbine casing.

8. The gas turbine as set out in claim 6, wherein said first sealing structure on each of said vanes defines at least in part a radially innermost surface of said vane having a curvature in a circumferential direction.

9. The gas turbine as set out in claim 6, wherein said inner diameter platform of each of said vanes having a substantially constant thickness in a radial direction throughout its entirety.

10. The gas turbine as set out in claim 6, wherein said first sealing structure comprises one of an abrasive layer, labyrinth teeth and honeycomb seal material.

11. The gas turbine as set out in claim 6, wherein said first seal member comprises a single row of fingers in a radial direction, wherein gaps are provided between adjacent fingers.

12. The gas turbine as set out in claim 6, wherein said first seal member comprises first and second rows of fingers, where first gaps are provided between adjacent first fingers and second gaps are provided between adjacent second fingers, said first row of fingers being radially spaced from said second row of fingers and said first gaps being spaced apart from said second gaps in a circumferential direction.

13. The gas turbine as set out in claim 6, wherein said seal housing apparatus comprises radially inner and outer seal housing structures, said radially outer seal housing structure having a radially outer surface comprising said second sealing structure adapted to cooperate with said first sealing structure provided on each of said vanes.

14. Sealing apparatus in a gas turbine comprising forward and aft rows of rotatable blades coupled to a disc/rotor assembly and a row of stationary vanes positioned between the forward and aft rows of rotatable blades, said sealing apparatus comprising:

seal housing apparatus coupled to the disc/rotor assembly and comprising radially inner and outer seal housing structures;

first seal retainer plate structure associated with the forward row of rotatable blades;

second seal retainer plate structure associated with the aft row of rotatable blades;

a first seal member positioned between said inner and outer seal housing structures for sealing a gap between said first seal retainer plate structure and said seal housing apparatus; and a second seal member positioned between said inner and outer seal housing structures for sealing a gap between said second seal retainer plate structure and said seal housing apparatus.

15. The sealing apparatus as set out in claim 14, wherein each vane in the row of stationary vanes is coupled to an inner diameter platform comprising first sealing structure adapted to engage with said seal housing apparatus.

16. The sealing apparatus as set out in claim 15, further comprising a bore extending through each vane in the row of stationary vanes and at least one cooling air passage provided in said inner diameter platform in communication with said bore, wherein cooling air passes into said bore and out through said at least one cooling air passage during operation of the gas turbine.

17. The sealing apparatus as set out in claim 15, wherein said radially outer seal housing structure has a radially outer surface comprising second sealing structure adapted to engage with said first sealing structure provided on said inner diameter platform.

18. The sealing apparatus as set out in claim 14, wherein said first seal member comprises a single row of fingers in a radial direction, wherein gaps are provided between adjacent fingers.

19. The sealing apparatus as set out in claim 14, wherein said first seal member comprises first and second rows of fingers, where first gaps are provided between adjacent first fingers and second gaps are provided between adjacent second fingers, said first row of fingers being radially spaced from said second row of fingers and said first gaps being spaced apart from said second gaps in a circumferential direction.

* * * * *